US005275540A

United States Patent [19]

Brown

[11] Patent Number: 5,275,540

[45] Date of Patent: Jan. 4, 1994

[54] LINEAR FLUID MOTOR SYSTEM

[76] Inventor: Harold D. Brown, Box 394, Nickerson, Kans. 67571

[21] Appl. No.: 852,655

[22] Filed: Mar. 17, 1992

[51] Int. Cl.[5] ..... F04B 47/08

[52] U.S. Cl. ..... 417/404

[58] Field of Search ..... 417/404, 403

[56] References Cited

U.S. PATENT DOCUMENTS

| | | | |
|---|---|---|---|
| 587,220 | 7/1897 | Maher . | |
| 842,406 | 1/1907 | Lewis . | |
| 1,277,382 | 9/1918 | Chapman et al. . | |
| 1,599,464 | 9/1926 | Flynn . | |
| 1,851,801 | 3/1932 | Boone | 417/404 |
| 1,926,856 | 9/1933 | Lenean . | |
| 2,003,446 | 6/1935 | Imler et al. . | |
| 2,028,067 | 1/1936 | Heftye . | |
| 2,028,938 | 1/1936 | Logette et al. . | |
| 2,081,223 | 5/1937 | Coberly | 417/404 |
| 2,379,483 | 7/1945 | Hapgood . | |
| 2,443,568 | 6/1948 | Palm . | |
| 2,475,429 | 7/1949 | Humason . | |
| 2,507,352 | 5/1950 | Scholes . | |
| 2,576,924 | 12/1951 | Coberly | 417/404 |
| 2,601,198 | 6/1952 | Willson . | |
| 2,642,045 | 6/1953 | Potts . | |
| 2,742,880 | 4/1956 | Ball . | |
| 2,784,700 | 3/1957 | Griffith . | |
| 2,853,016 | 9/1958 | Furrer | 417/404 |
| 2,869,469 | 1/1959 | Williams . | |
| 2,874,641 | 2/1959 | McCandlish et al. . | |
| 2,925,782 | 2/1960 | Sharpe et al. . | |
| 3,161,067 | 12/1964 | Möller . | |
| 3,212,406 | 10/1965 | McDuffie . | |
| 3,247,668 | 4/1966 | Vn Hecke et al. . | |
| 3,548,717 | 12/1970 | Passaggio . | |
| 3,643,432 | 2/1972 | Klaeger . | |
| 3,771,609 | 11/1973 | Walther . | |
| 3,846,048 | 11/1974 | Robbins, Jr. . | |
| 4,188,786 | 2/1980 | Franch . | |
| 4,462,464 | 7/1984 | Brown et al. . | |
| 4,541,783 | 9/1985 | Walling | 417/404 |
| 4,674,958 | 6/1987 | Igarashi et al. . | |
| 4,738,600 | 4/1988 | Safford | 417/403 |
| 4,871,302 | 10/1989 | Clardy et al. | 417/404 |
| 4,899,638 | 2/1990 | Brown . | |

FOREIGN PATENT DOCUMENTS

| | | |
|---|---|---|
| 1024526 | 2/1958 | Fed. Rep. of Germany . |

*Primary Examiner*—Richard E. Gluck

*Attorney, Agent, or Firm*—Litman, McMahon & Brown

[57] ABSTRACT

An improved linear fluid motor system, which is adapted to be driven by pressurized hydraulic fluid from a hydraulic pump, includes a piston rod having a first head interacting with product fluid and a second head interacting with hydraulic fluid, a first spool valve and a second spool valve interacting with the second piston head to control a third spool valve which reverses the displacement of the piston rod at its limits of travel, a first accumulator, and a second accumulator for cushioning abrupt pressure changes in the hydraulic fluid, a heater for heating the hydraulic fluid, a control valve for controlling the product fluid pumping rate of the system, interconnections for connecting the various components of the system, stops for defining the various configurations of the system, a detent mechanism for restraining the third spool valve in its switching configurations, and a coaxial conduit for conveying the hydraulic fluid between the hydraulic pump and the system whereby the product fluid is pumped from an input port to an output port. A modified embodiment includes integrally formed interconnections.

50 Claims, 5 Drawing Sheets

Fig. 3.
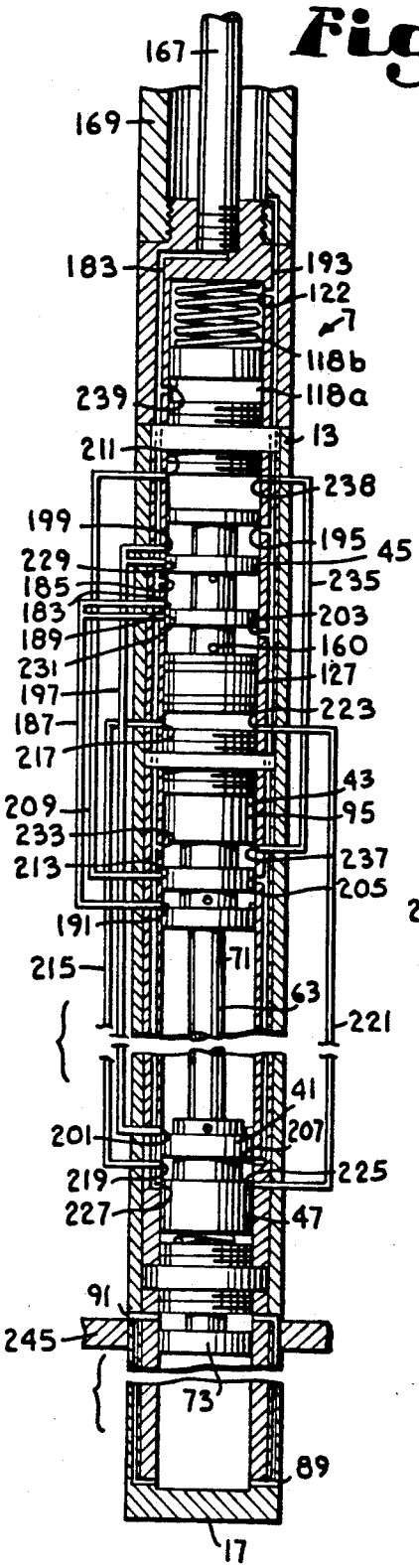
Fig. 4.
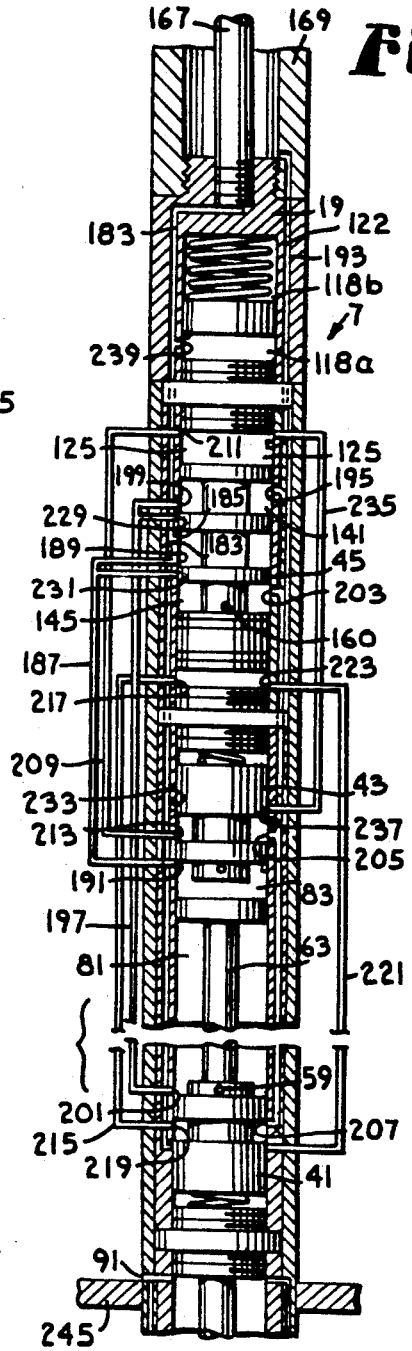
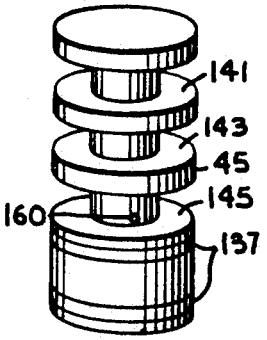
Fig. 5.
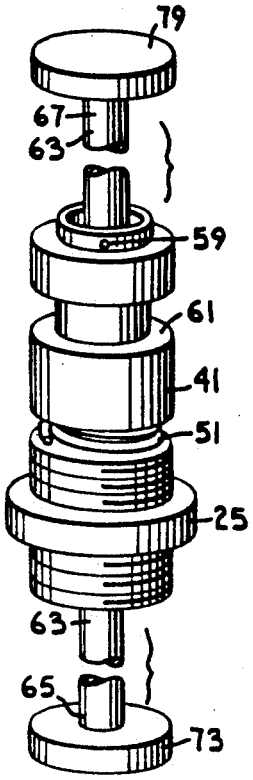
Fig. 6.

Fig.9.
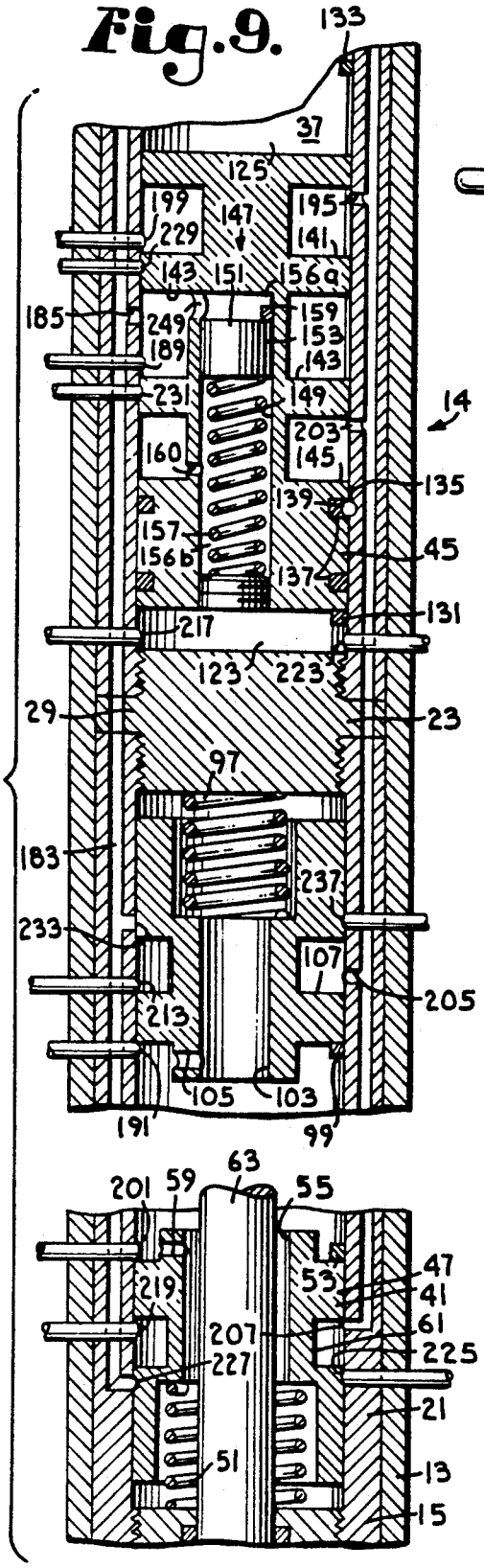
Fig.11.
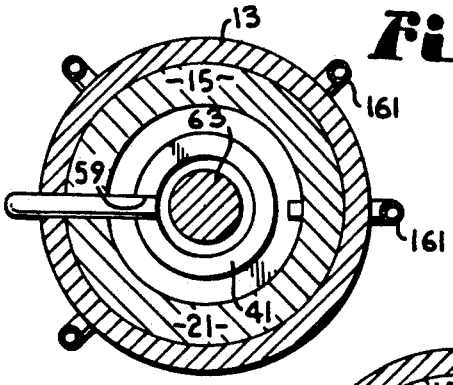
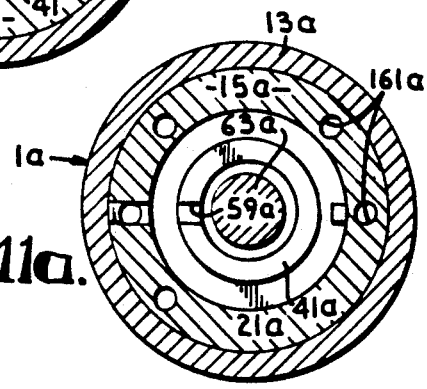
Fig.11a.
Fig.8.
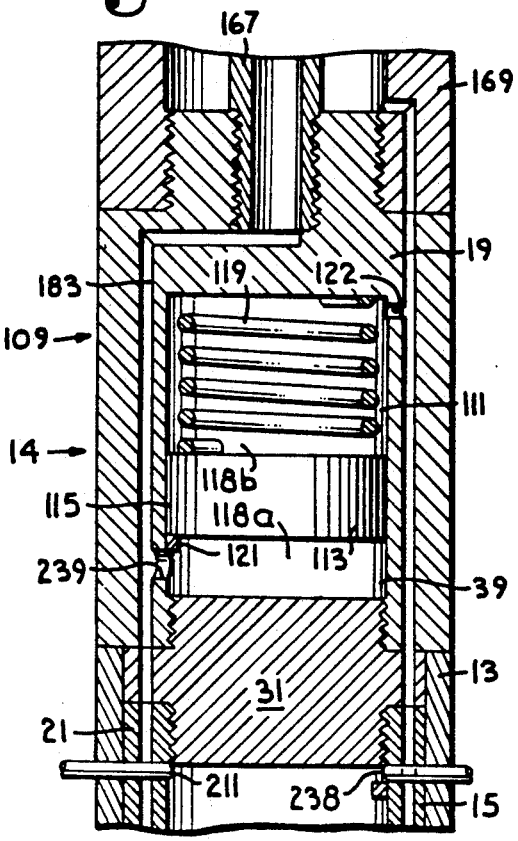

| 1st S.V. (41) | | 2nd S.V. (43) | | 3rd Spool Valve (S.V.) (45) | | | | | | | |
|---|---|---|---|---|---|---|---|---|---|---|---|
| First Bypass Cavity 61 | Lower Driving Chamber 81 | Upper Driving Chamber 83 | Second Bypass Cavity 107 | Lower Switching Chamber 123 | Lower Bypass Cavity 145 | Intermediate Bypass Cavity 143 | Upper Bypass Cavitv 141 | Upper Switching Chamber 125 | | | |
| | | X | | | | X | | | Source | Beginning of Downstroke | STEP 1 |
| X | X | | X | X | X | | X | X | Return | | |
| | | X | | | | X | | | Source | Downstroke | |
| X | X | | X | X | X | | X | X | Return | | |
| X | | X | | X | | X | | | Source | Ending of Downstroke | STEP 2 |
| | X | | X | | X | | X | X | Return | | |
| X | X | | | X | | X | | | Source | First Transition | STEP 3 |
| | | X | X | | X | | X | X | Return | | |
| | X | | | | | X | | | Source | Beginning of Upstroke | STEP 4 |
| X | | X | X | X | X | | X | X | Return | | |
| | X | | | | | X | | | Source | Upstroke | |
| X | | X | X | X | X | | X | X | Return | | |
| | X | | X | | | X | | X | Source | Ending of Upstroke | STEP 5 |
| X | | X | | X | X | | X | | Return | | |
| | | X | X | | | X | | X | Source | Second Transition | STEP 6 |
| X | X | | | X | X | | X | | Return | | |

Fig. 12.

LINEAR FLUID MOTOR SYSTEM

BACKGROUND OF THE INVENTION

1. Field of the Invention

The present invention relates generally to fluid-powered motors, and in particular, without limitation, to a reciprocating linear fluid pump for down-hole pumping of crude oil from an oil well.

2. Description of the Related Art.

Fluid-powered devices are well known and a variety of different designs have been devised to meet the requirements of particular applications. These include hydraulic and pneumatic piston-and-cylinder units which are connected to pumps and compressors. Piston-and-cylinder units, or linear actuators, are found in various sizes in many types of equipment. Single-acting piston-and-cylinder units generally have a single fluid input located at a cylinder end and provide a linear force in one direction. Double-acting units generally include fluid inlets at both ends of their cylinders and provide linear force on both their extension and retraction strokes. Most hydraulic systems are "closed" whereby the actuating fluid is returned from the piston-and-cylinder units for recirculation. Pneumatic systems, on the other hand, can be "open" whereby the air, steam, etc. is released to the atmosphere after expending its energy and performing work.

Piston-and-cylinder units have heretofore been employed, for example, in petroleum recovery. Oil wells generally include submersible, reciprocating "down-hole" pumps in the production zone. These pumps are commonly actuated by pump jacks comprising pivotable walking beams connected to the pump at one end by a string of sucker rods and mounting counterweights at the other end to offset the load that must be lifted on each pumping stroke. This load, which comprises both the weight of the sucker rod string and the weight of the crude oil column in the well tubing, can be substantial in a relatively deep well. Accordingly, pump jacks often require massive counterweights. Electric motors or internal combustion engines are usually coupled to the walking beams by gear or belt-drive transmissions for providing the required rocking motion.

Although such pump jack systems have been extensively used for many years, they suffer from several disadvantages. The size, complexity and weight of a typical pump jack system, especially for a relatively deep well, add significantly to its cost. Moreover, power losses in the engines, motors and transmissions tend to reduce operating efficiencies. In fact, present electric power rates are such that the cost of operating an electric motor for a single pump jack may exceed $5,000.00 per month. Naturally, the initial and operating costs associated with pump jack systems are reflected in the cost of oil production. Furthermore, since pump jacks generally include large, moving parts that are clearly visible from a substantial distance, they tend to dramatically alter the visual aesthetics of the landscape wherever they are erected.

To overcome the aforementioned disadvantages of conventional pump jacks, hydraulic piston-and-cylinder units have heretofore been employed for actuating the down-hole pumps in oil wells. For example, a wellhead with a hydraulic pump actuator is disclosed in the Brown et al. U.S. Pat. No. 4,462,464 and includes a single-acting hydraulic piston-and-cylinder unit connected to a sucker rod string. A spool valve automatically reverses the piston-and-cylinder unit. Although the hydraulic pump actuator disclosed in that patent has certain advantages, its utility is somewhat limited because the single-acting cylinder is hydraulically driven only through its upstroke. The return or downstroke is accomplished by releasing the fluid in the cylinder lower end, whereby the piston is drawn downwardly by the weight of the sucker rod string. A double-acting actuator is often preferred for oil recovery, particularly if the down-hole pump is double-acting. For another example, a wellhead with an hydraulic actuator is disclosed in the Brown U.S. Pat. No. 4,899,638 and includes an automatically reversing, double-acting, fluid-actuated piston-and-cylinder unit.

Electrically-actuated valves have also been tried on oil recovery piston-and-cylinder units. For example, one system employs upper and lower limit switches for shifting a solenoid-actuated valve at the upper and lower ends of the cylinder stroke. The valve diverts pressurized fluid from the pump to one end or the other of the hydraulic cylinder. When the cylinder reaches its uppermost or lowermost position, one of the limit switches is opened or closed whereby the solenoid-actuated valve shifts and pressurized fluid is diverted to the other cylinder end.

Although this arrangement has some advantages over conventional pump jacks, a disadvantage is the dependence on the electromechanical switch and solenoid valve components. If one of these components fails, the solenoid valve may stick in one position and the system may be damaged by excessive fluid pressure accumulating in a cylinder end. Even if the system is not damaged, the failure of an important component may cause it to shut down. Downtime in oil producing rigs is generally very expensive, as are repairs since many rigs are in remote locations. Furthermore, since many rigs are unattended, a shutdown could go unnoticed until someone arrived to collect the accumulated oil and/or gas. It will be readily appreciated from the foregoing that reliability is extremely important in oil pumping systems.

What is needed is a pumping system which provides substantially reduced operating costs, and which can be utilized for applications not adaptable to conventional sucker-rod apparatus, such as slant-drilled wells, crooked-hole wells, and the like.

SUMMARY OF THE INVENTION

An improved linear fluid motor system is provided for fluidically pumping a product fluid from one location to another. The motor system includes a body partitioned into a first or pumping cavity, a second or driving cavity, a third or switching cavity, and a fourth or cushioning cavity. The motor system also includes a piston rod connected to a first piston head, which divides the first cavity into a lower pumping chamber and an upper pumping chamber, and a second piston head, which divides the second cavity into a lower driving chamber and an upper driving chamber.

The motor system also includes a first spool valve slidably mounted in the lower driving chamber, a second spool valve slidably mounted in the upper driving chamber, and a third spool valve slidably mounted in the third cavity such that the third cavity is divided into a lower switching chamber and an upper switching chamber. The first spool valve has a first spool spring which urges the first spool valve from a first switching configuration to a first neutral configuration; similarly, the second spool valve has a second spool spring which urges the second spool valve from a second switching configuration to a second neutral configuration. The third spool valve has a lower switching configuration and an upper switching configuration.

The motor system is adapted to be energized by a hydraulic pump pumping pressurized hydraulic fluid through the motor system via a supply conduit and a return conduit.

As the first spool valve is in the first neutral configuration, the second spool valve is in the second neutral configuration, and the third spool valve is in the lower switching configuration, a plurality of interconnections connects pressurized hydraulic fluid from the supply conduit to the second piston head such that the piston rod is displaced toward an extended configuration. As the piston rod nears and reaches the extended configuration, the second piston head urges the first spool valve from the first neutral configuration to the first switching configuration, thereby connecting the lower switching chamber to the pressurized hydraulic fluid such that the third spool valve is displaced from the lower switching configuration to the upper switching configuration.

As the third spool valve is displaced from the lower switching configuration to the upper switching configuration, the upper driving chamber is disconnected from the pressurized hydraulic fluid and the lower driving chamber is connected to the pressurized hydraulic fluid, causing the piston rod to be displaced toward a retracted configuration. As the piston rod is initially displaced toward the retracted configuration, the first spool spring urges the first spool valve from the first switching configuration to the first neutral configuration, thereby disconnecting the lower switching chamber from the pressurized hydraulic fluid.

As the piston rod nears and reaches the retracted configuration, the second piston head urges the second spool valve from the second neutral configuration to the second switching configuration, thereby causing the upper switching chamber to be connected to the pressurized hydraulic fluid such that the third spool valve is displaced from the upper switching configuration to the lower switching configuration. As the third spool valve is displaced from the upper switching configuration to the lower switching configuration, the lower driving chamber is disconnected from the pressurized hydraulic fluid and the upper driving chamber is connected to the pressurized driving fluid, thereby causing the piston rod to be displaced from the retracted configuration toward the extended configuration. As the piston rod is initially displaced toward the extended configuration, the second spool spring urges the second spool valve from the second switching configuration to the second neutral configuration such that the upper switching chamber is disconnected from the pressurized hydraulic fluid.

The system also includes a first accumulator connected to the source conduit and a second accumulator contained within the third spool valve, each of which is adapted to cushion abrupt changes of pressure in the pressurized hydraulic fluid.

A detent mechanism is provided to restrain the third spool valve in the lower switching configuration and in the upper switching configuration. A plurality of stops is provided to define the various configurations in the system.

Throughbores and orifices are provided to equalize pressure of the hydraulic fluid about the first spool valve and the second spool valve. Interconnections are provided to equalize the hydraulic pressure in the upper switching chamber and the lower switching chamber as the first spool valve is in the first neutral configuration and the second spool valve is in the second neutral configuration.

A set of one-way valves is provided such that product fluid flows out of the upper pumping chamber through an output port and into the lower pumping chamber through an input port as the piston rod is displaced from the extended configuration to the retracted configuration and, further, the product fluid flows out of the lower pumping chamber through the output port and into the upper pumping chamber through the input port as the piston rod is displaced from the retracted configuration to the extended configuration.

For oil well applications, a packer is positioned exteriorally to the body, essentially dividing the oil well such that the input port communicates with the oil well below the packer and the output port communicates with the oil well above the packer. The motor system is adapted to be suspended by the supply conduit and the return conduit.

The system includes a reservoir, having an atmospheric vent, for receiving the hydraulic fluid being returned to the hydraulic pump by the return conduit. A heater is provided to heat the hydraulic fluid being circulated through the system. A control valve controls the pumping rate of the system by controlling the volume of hydraulic fluid being pumped through the system.

A modified embodiment of a linear fluid motor system provides interconnections which are integrally formed within a sidewall of a body of the motor system.

PRINCIPAL OBJECTS AND ADVANTAGES OF THE INVENTION

The principal objects and advantages of the present invention are: to provide a hydraulically-actuated linear fluid motor system; to provide such a linear fluid motor system which is double-acting; to provide such a linear fluid motor system which reverses automatically; to provide such a linear fluid motor system which is highly reliable; to provide such a linear fluid motor system which is capable of moving relatively large volumes of product fluid; to provide such a linear fluid motor system which can be made with various stroke lengths; to provide such a linear fluid motor system with at least one spool valve for automatically reversing the direction of piston travel and which is positively actuated at a corresponding limit of piston travel; to provide such a linear fluid motor system with a heater for heating hydraulic fluid used to activate the system; to provide such a linear fluid motor system with at least one accumulator for cushioning abrupt pressure changes in the hydraulic fluid used to activate the system; to provide such a linear fluid motor system with integrally formed interconnections; to provide such a linear fluid motor system which can be used in slant-drilled oil wells and in crooked-hole oil wells; and to provide such a linear fluid motor system which is economical to manufacture, efficient in operation, capable of a long operating life and particularly well adapted for the proposed usage thereof.

Other principal objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is an enlarged and fragmentary view of the linear fluid motor system, showing the first spool valve in a first neutral configuration and the second spool valve in a second switching configuration.

FIG. 4 is an enlarged and fragmentary view of the linear fluid motor system, showing the first spool valve in the first neutral configuration, the second spool valve in the second neutral configuration and the third spool valve in a lower switching configuration.

FIG. 5 is a further enlarged and perspective, fragmentary view of the linear fluid motor system, showing the third spool valve.

FIG. 6 is a further enlarged and perspective, fragmentary view of the linear fluid motor system, showing a piston rod mounted through the first spool valve and through a first partition wall.

FIG. 8 is a yet further enlarged and fragmentary view of the linear fluid motor system, showing the first accumulator in the first uncompressed configuration.

FIG. 9 is a yet further enlarged and fragmentary view of the linear fluid motor system, showing the second accumulator in a second compressed configuration and showing a detent mechanism.

FIG. 11 is a yet further enlarged and cross-sectional view of the linear fluid motor system, taken generally along line 11—11 of FIG. 7*b*, according to the present invention.

FIG. 11*a* is a yet further enlarged, horizontal, cross-sectional view of the first modified or alternative linear fluid motor system, corresponding to that shown for the primary embodiment in FIG. 11.

FIG. 12 is a chart describing various operational steps of the linear fluid pump system.

DETAILED DESCRIPTION OF THE INVENTION

Figure 10:
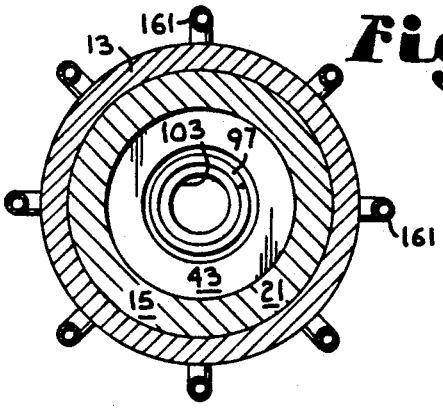
FIG. 10 is a yet further enlarged and cross-sectional view of the linear fluid motor system, taken generally along line 10—10 of FIG. 7*b*.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

The reference numeral 1 generally refers to a linear fluid motor system in accordance with the present invention, as shown in FIGS. 1 through 11. The system 1 generally includes energizing means 3, fluidic means 5, and linear fluid motor means 7. The motor means 7 generally includes pumping means 8 (FIG. 2), controlling means 9, interconnecting means 11, and containing means 13. The motor means 7 may also include cushioning means (FIGS. 8 and 9). The containing means 13 generally includes a body 15 (FIG. 7*a*) having a lower or bottom wall 17 (FIG. 2) an upper or top wall 19, a preferably cylindrically shaped side wall 21 (FIG. 7*a*) and partitioning means 23 (FIG. 9).

Figure 7A:
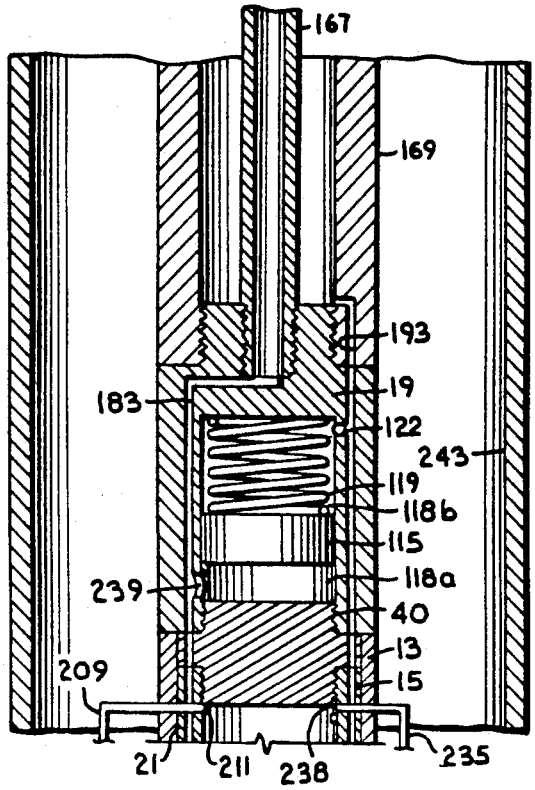
FIG. 7*a* is a still further enlarged and fragmentary view of the linear fluid motor system, showing the linear fluid motor system installed in an oil well casing and showing the first accumulator in a first uncompressed configuration.
Figure 7B:
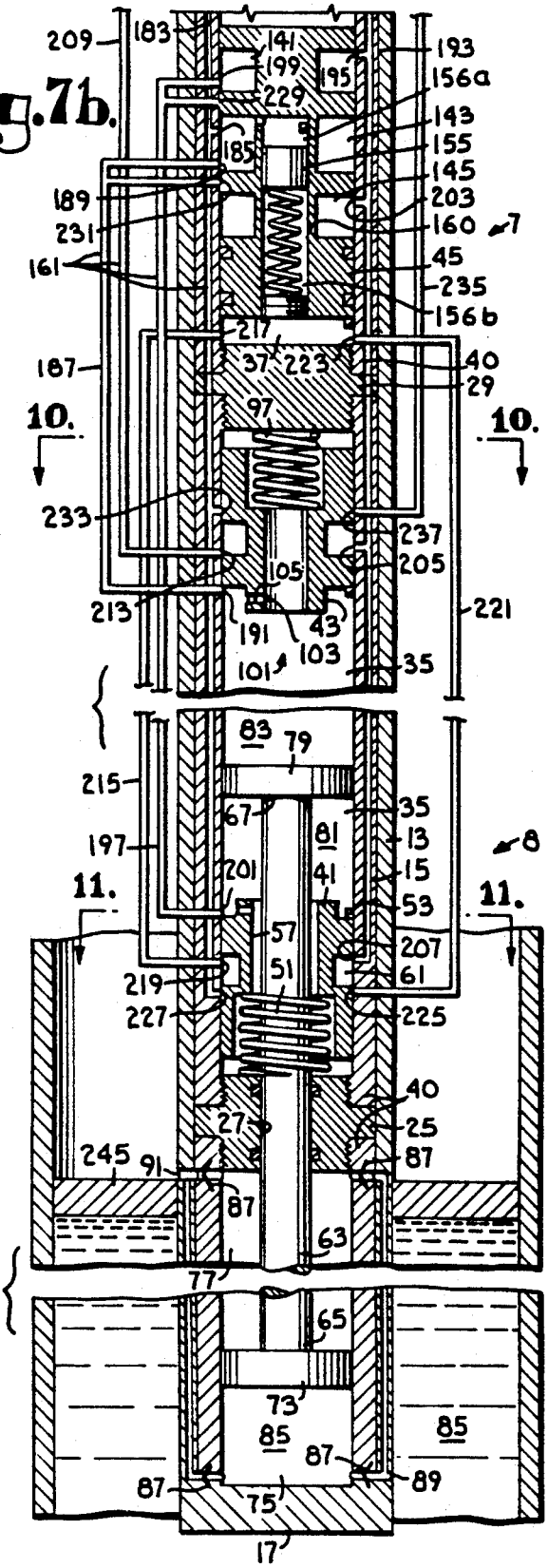
FIG. 7*b* is a still further enlarged and fragmentary view of the linear fluid motor system, showing a second accumulator in a second compressed configuration, the first spool valve in the first neutral configuration, the second spool valve in the second neutral configuration, and the third spool valve in the lower switching configuration and showing a plurality of interconnections.

The partitioning means 23 generally includes a first partition 25 (FIG. 2) having a generally centrally located partition throughbore 27 (FIG. 7*b*), a second partition 29 (FIG. 2), and a third partition 31. The first partition 25 is adapted to form a first cavity 33 between the bottom wall 17 and the first partition 25. Similarly, the second partition 29 is adapted to form a second cavity 35 between the first partition 25 and the second partition 29 and the third partition 31 is adapted to form a third cavity 37 (FIG. 9) between the second partition 29 and the third partition 31 and to further form a fourth cavity 39 (FIG. 2) between the third partition 31 and the top wall 19. The body 15 may comprise a plurality of cylinders 40 (FIG. 7*a*) threadably connected to the first partition 25, the second partition 29, and the third partition 31, as shown in FIGS. 7*a* and 7*b*.

The controlling means 9 generally includes a first spool valve 41, (FIG. 7*b*) a second spool valve 43, and a third spool valve 45. The first spool valve 41 is slidably mounted in the second cavity 35 in close proximity to the first partition 25 whereby the first spool valve 41 is axially displaceable between a first neutral configuration, as indicated by the numeral 47 in FIG. 3 and a first switching configuration, as indicated by the numeral 49 in FIG. 2. Generally, the displacement between the first neutral configuration 47 and the first switching configuration 49 is approximately ⅜ inch. A first spool valve spring 51 (FIG. 7b) is adapted to urge the first spool valve 41 from the first switching configuration 49 to the first neutral configuration 47. A first spool stop 53 is adapted to define the first neutral configuration 47.

The first spool valve 41 also has a first pressure equalizing means 55 (FIG. 9), such as a first throughbore 57 (FIG. 7b), which is adapted to equalize pressure about the first spool valve 41. For some applications, the first spool valve 41 also has a first bypass orifice 59 (FIG. 9) which is adapted, in cooperation with the first throughbore 57, to equalize pressure about the first spool valve 41. The first spool valve 41 also has a first bypass cavity 61 (FIG. 7b) which is adapted to intermittently establish flow communication with the interconnecting means 11.

The pumping means 8 generally includes a piston rod 63 (FIGS. 2 and 6) having a first rod end 65 and a second rod end 67. The piston rod 63 is slidably mounted through the partition throughbore 27 and loosely mounted through the first throughbore 57 such that the piston rod 63 is axially displaceable between an extended configuration, as indicated by the numeral 69 in FIG. 2, and a retracted configuration, as indicated by the numeral 71 in FIG. 3, which defines the limits of travel of the piston rod 63. Depending on the particular application, the displacement of the piston rod 63 between the extended configuration 69 and the retracted configuration 71 may be relatively short or may be thirty to forty feet long, or longer.

The pumping means 8 also includes a first piston head 73 connected to the first rod end 65. The first piston head 73 is slidably mounted in the first cavity 33 such that the first piston head 73 is axially displaceable therein. The first piston head 73 is adapted to form an outer or lower pumping chamber 75 (FIG. 7b) between the first piston head 73 and the bottom wall 17 and to form an inner or upper pumping chamber 77 between the first piston head 73 and the first partition 25.

The pumping means 8 also has a second piston head 79 connected to the second rod end 67. The second piston head 79 is slidably mounted in the second cavity 35 such that the second piston head 79 is axially displaceable therein. The second piston head 79 is adapted to form a lower driving chamber 81 between the second piston head 79 and the first partition 25 and to form an upper driving chamber 83 between the second piston head 79 and the second partition 29. The second piston head 79 is adapted to urge the first spool valve 41 from the first neutral configuration 47 to the first switching configuration 49 as the piston rod 63 nears and reaches the extended configuration 69. The pumping means 8 is adapted to pump product fluid 85, such as crude oil or the like, with the product fluid 85 being responsive to the first piston head 73 as the second piston head 79 responds to pressure differentials in the fluidic means 5, as hereinafter described.

The pumping means 8 generally includes a set of one-way valves 87 which are adapted such that the product fluid 85 concurrently flows into the lower pumping chamber 75 through an input port 89 and out of the upper pumping chamber 77 through an output port 91 as the piston rod 63 is displaced from the extended configuration 69 to the retracted configuration 71. The set of one-way valves 87 are further adapted such that the product fluid 85 concurrently flows out of the lower, pumping chamber 75 through the output port 91 and concurrently into the upper pumping chamber 77 through the input port 89 as the piston rod 63 is displaced from the retracted configuration 71 to the extended configuration 69.

The second spool valve 43 (FIG. 7b) is slidably mounted in the second cavity 35 in close proximity to the second partition 29 such that the second spool valve 43 is axially displaceable in the second cavity 35. The second spool valve 43 has a second neutral configuration, as indicated by the numeral 93 in FIG. 2, and a second switching configuration, as indicated by the numeral 95 in FIG. 3. Generally, the displacement between the second neutral configuration 93 and the second switching configuration 95 is approximately ⅜ inch. The second spool valve 43 has a second spool spring 97 which is adapted to urge the second spool valve 43 from the second switching configuration 95 to the second neutral configuration 93. A second spool stop 99 (FIG. 9) is adapted to define the second neutral configuration 93. All stops in the system 1, such as the stop 99, can be a stop-ring or other suitable device.

The second spool valve 43 has second pressure equalizing means 101 (FIG. 7b), such as a second throughbore 103, for equalizing the pressure about the second spool valve 43. For some applications, the second pressure equalizing means 101 may include a second bypass orifice 105 (FIG. 9) for cooperating with the second throughbore 103. The second spool valve 43 also includes a second bypass cavity 107 which is adapted to intermittently establish flow communication with the interconnecting means 11. The second piston head 79 is adapted to urge the second spool valve 43 from the second neutral configuration 93 to the second switching configuration 95 as the piston rod 63 nears and reaches the retracted configuration 71.

The cushioning means 14 (FIG. 9) generally includes a first accumulator 109 (FIG. 8) disposed in the fourth cavity 39. The first accumulator 109 has a first buffer cavity 111, a first buffer plate 113 mounted in the first buffer cavity 111 such that the first buffer plate 113 is axially displaceable between a first uncompressed configuration, as indicated by the numeral 115 in FIG. 8, and a first compressed configuration, as indicated by the numeral 117 in FIG. 2. The first buffer plate 113 is adapted to partition the first buffer cavity 111 into an outer first buffer chamber 118a and an inner first buffer chamber 118b.

A first accumulator spring 119 is disposed in said inner first buffer chamber 118b and is adapted to urge the first buffer plate 113 from the first compressed configuration 117 to the first uncompressed configuration 155. A first buffer stop 121 is adapted to define the first uncompressed configuration 115. A first bleed port 122 is adapted to connect the inner first buffer chamber 118b in flow communication with the fluidic means 5 being returned to the energizing means 3.

The third spool valve 45 (FIGS. 4, 5, and 9) is slidably mounted in the third cavity 37 such that the third spool valve 45 is axially displaceable in the third cavity 37. The third spool valve 45 is adapted to form a lower switching chamber 123 (FIG. 9) between the second partition 29 and the third spool valve 45 and to form an upper switching chamber 125 between the third spool valve 45 and the third partition 31. The third spool valve 45 has a lower switching configuration, as indicated by the numeral 127 in FIG. 3, and an upper switching configuration, as indicated by the numeral 129 in FIG. 2, as hereinafter described. Generally, the displacement between the lower switching configuration 127 and the upper switching configuration 129 is approximately ½ inch.

The third spool valve 45 is adapted to be urged by the fluidic means 5, as pressurized by the energizing means 3, from the lower switching configuration 127 to the upper switching configuration 129 and from the upper switching configuration 129 to the lower switching configuration 127. Generally, approximately 3–4 ounces of the fluidic means 5 is required to displace the third spool valve 45 between the lower switching configuration 127 and the upper switching configuration 129.

The third spool valve 45 has a third spool lower stop 131 (FIG. 9) adapted to define the lower switching configuration 127 and a third spool upper stop 133 adapted to define the upper switching configuration 129. Restraining means, such as a detent mechanism 135 having a pair of spaced grooves 137 and a biased ball 139, is adapted to restrain the third spool valve 45 in the lower switching configuration 127 and in the upper switching configuration 129.

The third spool valve 45 also has an upper bypass cavity 141, an intermediate bypass cavity 143, and a lower bypass cavity 145, each adapted to intermittently establish flow communication with the interconnecting means 11

For some applications, the cushioning means 14 may include a second accumulator 147 disposed in the intermediate bypass cavity 143. The second accumulator 147 has a second buffer cavity 149 and a second buffer plate 151 mounted in the second buffer cavity 149 such that the second buffer plate 151 is axially displaceable between a second uncompressed configuration, as indicated by the numeral 153 in FIG. 9, and a second compressed configuration, as indicated by the numeral 155 in FIG. 7*b*. The second buffer plate 151 is adapted to partition the second buffer cavity 149 into an outer second buffer chamber 156*a* and an inner second buffer chamber 156*b*.

A second accumulator spring 157 is disposed in said inner second buffer chamber 156*b* and is adapted to urge the second buffer plate 151 from the second compressed configuration 155 to the second uncompressed configuration 153. A second buffer stop 159 is adapted to define the second uncompressed configuration 153. A second bleed port 160 is adapted to connect the inner buffer chamber 156*b* in flow communication with the fluidic means 5 being returned to the energizing means 3.

The interconnecting means 11 is adapted to fluidically interconnect the pumping means 8 and the controlling mean 9 with the energizing means 3. The interconnecting means 11 may comprise a plurality of tubes or interconnections 161 (FIG. 7*b*).

The energizing means 3, such as a hydraulic pump 164 (FIG. 1) or the like, are generally remotely located from the pumping means 8 with fluid conveying means 165 adapted to convey the fluidic means 5, such as hydraulic fluid 166 or the like, between the energizing means 3 and the pumping means 8. The fluid conveying means 165 generally includes a supply line or conduit 167 adapted to convey the fluidic means 5 from the energizing means 3 to the pumping means 8 and a return line or conduit 169 adapted to convey the fluidic means 5 from the pumping means 8 to the energizing means 3. In some applications, the supply conduit 167 and the return conduit 169 are generally coaxial or annulus-type tubing.

The energizing means 3 energizes the pumping means 8 by maintaining a pressure differential between the fluidic means 5 contained in the supply conduit 167 and the fluidic means 5 contained in the return conduit 169, for example, a pressure differential of approximately 1,000 psi. The return conduit 169 is generally connected to a reservoir 17 having an atmospheric vent 173. The reservoir 171 is adapted to receive the fluidic means 5 being conveyed from the pumping means 8 and to supply the fluidic means 5 to the energizing means 3.

The rate at which the pumping means 8 pumps the product fluid 85 is controlled by rate control means, such as a fluid valve 175 which is adapted to alter the rate of flow of the fluidic means 5 to the pumping means 8 from the energizing means 3. Heating means, such as a heater 177, are adapted to heat the fluidic means 5 being circulated through the pumping means 8.

As the first spool valve 41 is in the first neutral configuration 47, the second spool valve 43 is in the second neutral configuration 93, and the third spool valve 45 is in the lower switching configuration 127, one of the interconnections 161, as indicated by the numeral 183 in FIG. 7*b*, connects the intermediate bypass cavity 143 to the source conduit 167 through port 185 and one of the interconnections 161, as indicated by the numeral 187 in FIG. 4, connects the upper driving chamber 83 to the intermediate bypass cavity 143 through ports 189 and 191. Similarly, one of the interconnections 161, as indicated by the numeral 193 in FIG. 4, connects the upper bypass cavity 141 to the return conduit 169 through port 195 and one of the interconnections 161, as indicated by the numeral 197 in FIG. 4, connects the lower driving chamber 81 to the upper bypass cavity 141 through the ports 199 and 201.

In addition, the return conduit 169 is connected by the interconnection 193 to the lower bypass cavity 145 through the port 203, to the second bypass cavity 107 through port 205 and to the first bypass cavity 61 through the port 207. Also, one of the interconnections 161, as indicated by the numeral 209 in FIG. 4, connects the upper switching chamber 125 to the return conduit 169 by connecting the upper switching chamber 125 to the second bypass cavity through ports 211 and 213, and one of the interconnections 161, as indicated by the numeral 215 in FIG. 4, connects the lower switching chamber 123 to the return conduit 169 by connecting the lower switching chamber 123 to the first bypass cavity 61 through the ports 217 and 219.

Figure 2:
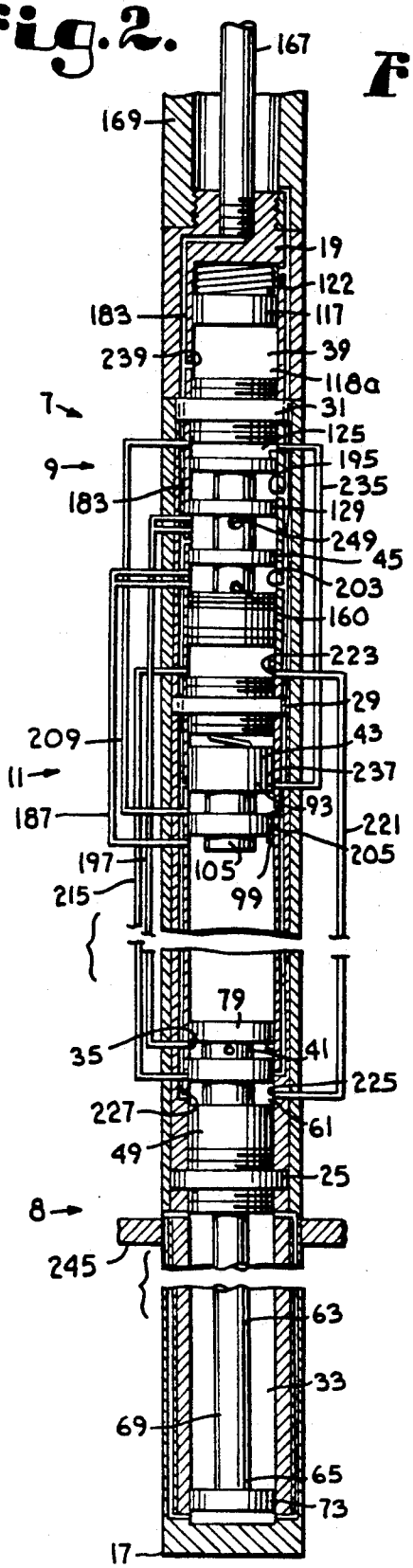
FIG. 2 is an enlarged and fragmentary view of the linear fluid motor system, showing a first accumulator in a compressed configuration, a first spool valve in a first switching configuration, a second spool valve in a second neutral configuration, and the third spool valve in an upper switching configuration.

As the second piston head 79 urges the first spool valve 41 from the first neutral configuration 47 to the first switching configuration 49, the interconnections 193 and 215 and the corresponding ports 207 and 219 are disconnected from the first bypass cavity 63; and further, the lower switching chamber 123 is connected to the supply conduit 167 by connecting the lower switching chamber 123 to the first bypass cavity 61 by one of the interconnections 161, as indicated by the numeral 221 in FIG. 2, through ports 223 and 225 and by connecting the first bypass cavity 61 to the interconnection 183 through port 227 in order to fluidically urge the third spool valve 45 from the lower switching configuration 127 to the upper switching configuration 129.

As the third spool valve 45 is urged from the lower switching configuration 127 to the upper switching configuration 129 (FIGS. 2, 3, and 7*b*), the interconnection 197 and the port 199 are disconnected from the upper bypass cavity 141 and the interconnection 187 and the port 189 are disconnected from the intermediate bypass cavity 143; and further, the interconnection 197 and the port 199 are connected to the supply conduit 167 through the intermediate bypass cavity 143, and the interconnection 187 and the port 189 are connected to the return conduit 169 through the lower bypass cavity 145 and the port 203.

In some applications, the intermediate bypass cavity 143 is also connected to the interconnection 197 through port 229 such that the connection of the lower driving chamber 81 to the supply conduit 167 through the intermediate bypass cavity 143 occurs in a stepwise manner. Similarly, the lower bypass cavity 145 may also be connected to the interconnection 187 by port 231 such that connection of the upper driving chamber 83 to the return conduit 169 also occurs in a stepwise manner.

As the piston rod 63 is initially urged from the extended configuration 69 toward the retracted configuration 71 and the first spool spring 51 urges the first spool valve 41 from the first switching configuration 49 to the first neutral configuration 47, the interconnections 183 and 221 and the ports 225 and 227 are disconnected from the first bypass cavity 61 and the interconnections 193 and 215 and the ports 219 and 207 are connected to the first bypass cavity 61 such that the first bypass cavity 61 and the lower switching chamber 123 are disconnected from the supply conduit 167 and are connected to the return conduit 169.

As the second piston head 79 urges the second spool valve 43 from the second neutral configuration 93 to the second switching configuration 95, the second bypass cavity 107 is disconnected from the interconnections 193 and 209 and the ports 205 and 213 and is connected to the interconnection 183 through port 233 and is also connected to one of the interconnections 161, as designated by the numeral 235 in FIG. 3, and the ports 237 and 238 such that the second bypass cavity 107 and the upper switching chamber 125 are each disconnected from the return conduit 169 and are connected to the supply conduit 167.

As the third spool valve 45 is urged from the upper switching configuration 129 to the lower switching configuration 127, the interconnection 197 and the ports 199 and 229 are disconnected from the intermediate bypass cavity 143 and the interconnection 187 and the ports 189 and 231 are disconnected from the lower bypass cavity 145 and, further, the interconnection 197 and the port 199 are connected to the upper bypass cavity 141 and the interconnection 187 and the port 189 are connected to the intermediate bypass cavity 143 such that the upper driving chamber 83 is disconnected from the return conduit 169 and is connected to the supply conduit 167 and the lower driving chamber 81 is disconnected from the supply conduit 167 and is connected to the return conduit 169.

As the piston rod 63 is initially urged from the retracted configuration 71 toward the extended configuration 69 such that the second spool spring 97 urges the second spool valve 43 from the second switching configuration 95 to the second neutral configuration 93, the second bypass cavity 107 is disconnected from the interconnections 183 and 235 and the ports 233 and 237 and is connected to the interconnections 193 and 209 and the ports 205 and 213 such that the upper switching chamber 125 and the second bypass cavity 107 are disconnected from the supply conduit 167 and are connected to the return conduit 169.

The fourth cavity 39 is connected to the interconnection 183 through port 239 such that the first accumulator 109 is available to automatically cushion abrupt pressure changes in the fluidic means 5. Similarly, the second accumulator 147 is connected to the interconnection 183 through the port 249, the intermediate bypass cavity 143 and the port 185 such that the second accumulator 147 is also available to automatically cushion abrupt pressure changes in the fluidic means 5.

It is foreseen that some applications may require other or alternatively positioned cushioning means 14 within the system 1. It is also foreseen that the stepwise connections, as hereinbefore described, may be needed at different or other locations within the system 1 for some applications.

APPLICATIONS

In an application of the present invention, the fluidic means 5 is pumped under pressure by the energizing means 3 through the fluid conveying means 165 to the interconnecting means 11, the controlling means 9, and the pumping means 8. The following operational description is shown in FIG. 12, with the arrows contained therein illustrating activity which occurs within each of the indicated steps, or part thereof.

As the first spool valve 41 is in the first neutral configuration 47 (FIG. 3), the piston rod 63 is in the retracted configuration 71, the second spool valve 43 is in the second switching configuration 95, and the third spool valve 45 is in the lower switching configuration 127, the fluidic means 5 in the upper driving chamber 83 applies pressure to the second piston head 79, thereby urging the piston rod 63 from the retracted configuration 71 (FIG. 3) toward the extended configuration 69 (FIG. 2), STEP 1 (downstroke) in FIG. 12.

As the piston rod 63 is urged toward the extended configuration 69, the first piston head 73 applies pressure to the product fluid 85 contained in the lower pumping chamber 75 such that the product fluid 85 is forced through the output port 91 (FIG. 7*b*). Concurrently therewith, the product fluid 85 flows through the input port 89 into the inner pumping chamber 77.

As the piston rod 63 is initially displaced from the retracted configuration 71 toward the extended configuration 69, the second bypass orifice 105 in conjunction with the second throughbore 103 equalizes the pressure of the fluidic means 5 about the second spool valve 43 whereby the second spool spring 97 causes the second spool valve 43 to follow the second piston head 79 such that the second spool valve 43 is displaced from the second switching configuration 95 (FIG. 3) to the second neutral configuration 93, STEP 1 (beginning of downstroke) in FIG. 12.

As the second spool valve 43 is displaced from the second switching configuration 95 to the second neutral configuration 93 (FIG. 2), the upper switching chamber 125 is disconnected from the fluidic means contained in the supply conduit 167 and is connected to the return conduit 169.

As the piston rod 43 nears and reaches the extended configuration 69, the second piston head 79 bears against the first spool valve 41, urging the first spool valve 41 from the first neutral configuration 47 (FIG. 3) to the first switching configuration 49 (FIG. 2) and compressing the first spool spring 51, STEP 2 (ending of downstroke) in FIG. 12.

As the first spool valve 41 is urged from the first neutral configuration 47 to the first switching configuration 49, the lower switching chamber 123 is disconnected from the return conduit 169 and connected to the supply conduit 167 such that the fluid means 5 in the lower switching chamber 123 applies pressure to the third spool valve 45, causing the third spool valve 45 to be displaced from the lower switching configuration 127 (FIG. 3) to the upper switching configuration 129 (FIG. 2), STEP 3 (first transition) in FIG. 12.

As the third spool valve 45 is displaced from the lower switching configuration 127 to the upper switching configuration 129, the upper driving chamber 83 is disconnected from the fluidic means 5 contained in the supply conduit 167 and is connected to the return conduit 169 as the lower driving chamber 81 is disconnected from the return conduit 169 and is connected to the fluidic means 5 contained in the supply conduit 167 such that the fluidic means 5 contained in the lower driving chamber 81 applies pressure against the second piston head 79.

The first bypass orifice 59 in cooperation with the first throughbore 57 equalizes the pressure about the first spool valve 41 such that the first spool spring 51 causes the first spool valve 41 to follow the second piston head 79 as the piston rod 63 is initially displaced from the extended configuration 69 (FIG. 2) toward the retracted configuration 71 (FIG. 3), STEP 4 (beginning of upstroke) in FIG. 12.

As the first spool valve 41 is displaced from the first switching configuration 49 to the first neutral configuration 47, the lower switching chamber 123 is disconnected from the fluidic means 5 contained in the supply conduit 167 and is connected to the return conduit 169.

As the piston rod 63 is urged toward the retracted configuration 71, the first piston head 73 applies pressure to the product fluid 85 contained in the upper pumping chamber 77 such that the product fluid 85 is forced through the output port 91. Concurrently therewith, the product fluid 85 flows through the input port 89 into the lower pumping chamber 75, STEP 4 (upstroke) in FIG. 12.

As the piston rod 63 nears and reaches the retracted configuration 71, the second piston head 79 bears against the second spool valve 43, displacing the second spool valve 43 from the second neutral configuration 9 (FIG. 2) to the second switching configuration 95 (FIG. 3) and compressing the second spool spring 97, STEP 5 (ending of upstroke) in FIG. 12.

As the second spool valve 43 is displaced from the second neutral configuration 93 to the second switching configuration 95, the upper switching chamber 125 is disconnected from the return conduit 169 and is connected to the fluidic means 5 contained in the supply conduit 167 such that the fluidic means contained in the upper switching chamber 125 displaces the third spool valve 45 from the upper switching configuration 129 (FIG. 2) to the lower switching configuration 172, (FIG. 3) STEP 6 (second transition) in FIG. 12.

As the third spool valve 45 is displaced from the upper switching configuration 129 to the lower switching configuration 127, the lower driving chamber 81 is disconnected from the supply conduit 167 and connected to the return conduit 169 as the upper driving chamber 83 is disconnected from the return conduit 169 and connected to the fluidic means 5 contained in the supply conduit 167 whereby the pressure in the upper driving chamber 83 is greater than the pressure of the fluidic means 5 in the lower driving chamber 81, causing the piston rod 63 to be urged from the retracted configuration 71 (FIG. 3) toward the extended configuration 69 (FIG. 2).

Summarizing, the automatic and reciprocal operation of the system 1 can be briefly described as follows: with the first spool valve 41 in the first neutral configuration 47 (FIG. 3), the piston rod 63 is in the retracted configuration 71, the second spool valve 43 in the second switching configuration 95, and the third spool valve 45 in the lower switching configuration 127:

STEP 1: the piston rod 63 is displaced toward the extended configuration 69 (FIG. 2) and the second spool spring 97 urges the second spool valve 43 to the second neutral configuration 93;

STEP 2: the second piston head 79 urges the first spool valve 41 against the first spool spring 51 to the first switching configuration 49;

STEP 3: the third spool valve 45 is displaced to the upper switching configuration 129;

STEP 4: the piston rod 63 is displaced toward the retracted configuration 71 (FIG. 3) and the first spool spring 5 urges the first spool valve 41 to the first neutral configuration 47;

STEP 5: the second piston head 79 urges the second spool valve 43 against the second spool spring 97 to the second switching configuration 95; and STEP 6: the third spool valve 45 is displaced to the lower switching configuration 127, thereby returning the system 1 to STEP 1.

For applications where the motor means 7 is used down-hole in an oil well, having a wellhead 241 (FIG. 1) and a casing 243, for pumping crude oil as the product fluid 85, the fluidic conveying means 165 is adapted to suspend the motor means 7 from the wellhead 241. A packer 245 is adapted to partition the space between the containing means 13 and the casing 243 such that the input port 89 communicates with the oil well below the packer 245 and the output port 91 communicates with the oil well above the packer 245.

For oil well applications, power operating costs for the system 1 are generally substantially less than those o conventional oil well pump due to the fact that the pressure generated at the down-hole portion of the system by the column of the fluidic means 5 between the surface and the down-hole portion substantially counteracts the weight of the product fluid 85 being pumped to the surface, the major factor being the difference between the specific gravities of the fluidic means 5 and the product fluid 85. (This consideration is particularly important for oil wells as a pressure of approximately one pound per square inch is generated for each 2.31 feet of column height.) As a result, a substantial portion of the energy required to operate the system 1 is used largely to create the pressure differential between the fluidic means 5 contained in the supply conduit 167 and the fluidic means 5 contained in the return conduit 169 rather than to lift the product fluid 85 to the surface.

Figure 1:
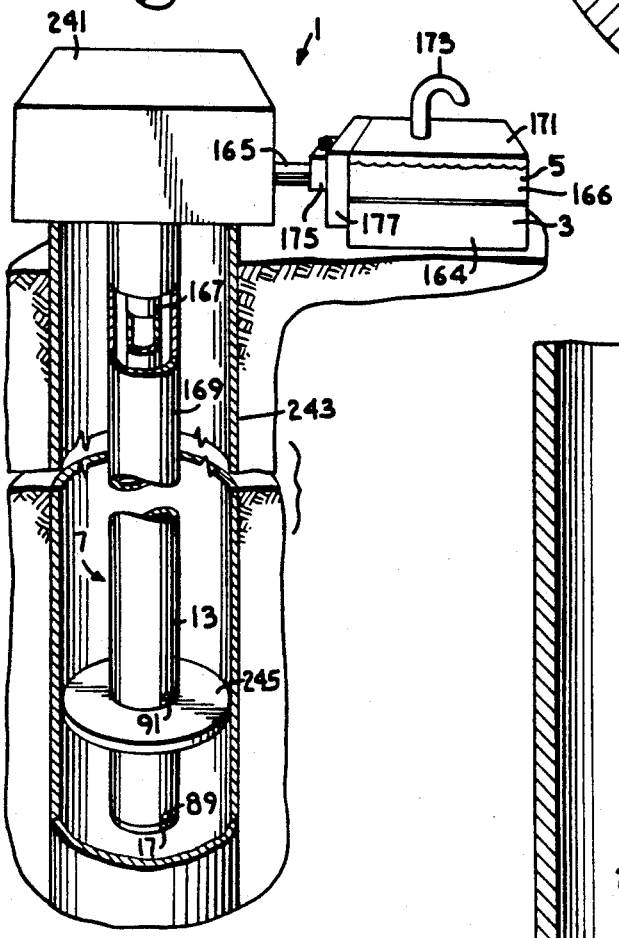
FIG. 1 is a perspective and fragmentary view of a linear fluid motor system, shown installed in an oil well having a wellhead and a casing, according to the present invention.

Also, since the sucker rods normally used in conventional pumping operations are not required when using the system 1 and since the system 1 can be constructed with a diameter less than the inside dimensions of an oil well casing, the system 1 is particularly well adapted for use with slant-drilled wells, crooked-hole wells, and other configurations which are not adaptable to sucker rod conventional pumping techniques. Further, the system 1 has a much lower profile than conventional pumping apparatus as the fluid conveying means 165 can be curved laterally near the earth surface, as indicated in FIG. 1.

It is foreseen that the linear fluid motor system 1 could also be used as a water pump, sludge pump, a trash pump, lift pump for sewage, and for a variety of other applications which require fluids to be transferred from one location to another. It is also foreseen that the first rod end 65 of the piston rod 63 could be fitted with an appropriate coupling and the linear fluid motor system 1 used to displace a load, such as a portion of an apparatus and the like, in an oscillatory manner.

MODIFIED OR ALTERNATIVE EMBODIMENT

Figure 10A:
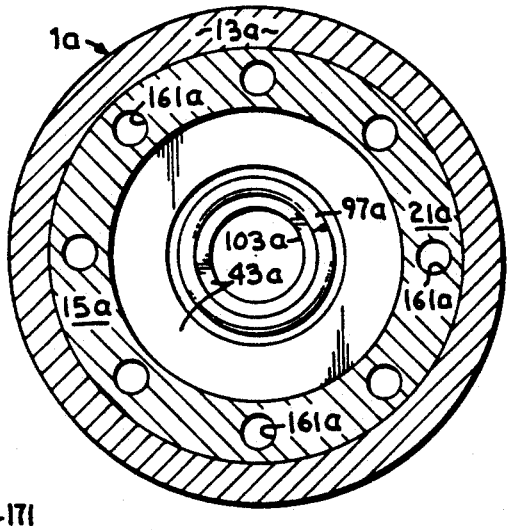
FIG. 10*a* is a greatly enlarged, horizontal, cross-sectional view of a linear fluid motor system, comprising a first modified or alternative embodiment of the present invention with tubing integrally formed within sidewalls of a body, corresponding to that shown for the primary embodiment in FIG. 10.

A modified or alternative embodiment of a linear fluid pump system 1*a* in accordance with the present invention is shown in FIGS. 10*a* and 11*a*. The linear fluid pump system 1*a* is constructed similar to and functions in a similar manner to the linear fluid pump system 1 comprising a primary embodiment of the present invention, except that the tubes 161 of the primary embodiment linear fluid pump system 1 are integrally formed in a sidewall 21*a* of a body 15*a*. The integrally formed fluid passages are designated by the reference numeral 161*a*. It will be appreciated that some or all of the tubes 161 of the primary embodiment linear fluid pump system 1 can be replaced by such fluid passages 161*a*. Otherwise, the fluid connections and the fluidic operation of the modified or alternative linear fluid pump system 1a can be substantially identical to the primary embodiment linear fluid pump system 1.

It is to be understood that while certain forms of the present invention have been illustrated and described herein, it is not to be limited to the specific forms or arrangement of parts described and shown.

What is claimed and desired to be secured by Letters Patent is as follows:

1. A linear fluid motor system for retrieving product fluid from a source, said motor system connected to an energizing means such that energy is transferred to said motor system be pressurized fluidic means from said energizing means, said motor system comprising:

(a) elongated tubular containing means closed at opposite ends and partitioned into a lower first cavity, an intermediate second cavity, and an upper third cavity respectively by a first partition, a second partition, and a third partition;

(b) pumping means including:

(1) a pump piston head positioned in said first cavity to define an outer pumping chamber and an inner pumping chamber on opposite sides thereof;

(2) a drive piston head positioned in said second cavity to define a lower driving chamber and an upper driving chamber on opposite sides thereof; and (3) a piston rod extending through said first partition and having said piston heads connected to opposite ends thereof;

(c) controlling means communicating said fluidic means alternately to said lower driving chamber and said upper driving chamber to thereby reciprocate said pumping means respectively between a retracted configuration and an extended configuration, said controlling means including:

(1) a first spool valve disposed in said lower driving chamber such that said first spool valve is slidably displaceable axially therein;

(2) a second spool valve disposed in said upper driving chamber such that said second spool valve is slidably displaceable axially therein; and (3) a third spool valve disposed in said third cavity such that said third spool valve is slidably displaceable axially therein between a lower switching configuration and an upper switching configuration; said third spool valve adapted to form a lower switching chamber between said third spool valve and said second partition, and to form an upper switching chamber between said third spool valve and said third partition; and (d) one-way valve means fluidically connecting said source alternately with one of the pumping chambers and connecting the other of said pumping chambers alternately with a product fluid outlet.

2. The motor system according to claim 1, wherein:

(a) said motor system is remotely located from the energizing means.

3. The motor system according to claim 1, wherein:

(a) said containing means includes a wall; and (b) interconnecting means are formed integrally within said wall, said interconnecting means fluidically interconnecting said pumping means and said controlling means.

4. The motor system according to claim 1, including:

(a) heating means for heating said fluidic means.

5. The motor system according to claim 1, including:

(a) cushioning means for automatically cushioning abrupt pressure changes in said fluidic means.

6. The motor system according to claim 1, wherein:

(a) the energizing means includes a hydraulic pump; and (b) the fluidic means includes hydraulic fluid.

7. The motor system according to claim 6, including:

(a) a reservoir adapted to receive said hydraulic fluid from said motor system and to supply said hydraulic fluid to said hydraulic pump; said reservoir vented to the atmosphere.

8. The motor system according to claim 1, including:

(a) rate control means for controlling the rate at which said motor system pumps the product fluid.

9. The motor system according to claim 8, wherein:

(a) said rate control means includes a fluid valve adapted to alter the flow of the fluidic means to said motor system from the energizing means.

10. The motor system according to claim 1, including:

(a) an input port;

(b) an output port; and (c) said one-way valve means includes a set of one-way valves adapted such that the product fluid flows into said outer pumping chamber through said input port and concurrently out of said inner pumping chamber through said output port as said piston rod is displaced form said extended configuration to said retracted configuration; said set on one-way valves further adapted such that the product fluid flows out of said outer pumping chamber through said output port and concurrently into said inner pumping chamber through said input port as said piston rod is displaced from said retracted configuration to said extended configuration.

11. The motor system according to claim 10 wherein the source includes an oil well with a wellhead and a casing, including:

(a) said motor system being adapted to be inserted down-hole in the oil well;

(b) said energizing means having fluid conveying means adapted to convey said fluidic means and to suspend said motor system from the wellhead; and (c) a packer adapted to partition the oil well such that said input port communicates with the oil well below said packer and said output port communicates with the oil well above said packer.

12. A down-hole linear pump system for pumping crude oil from an oil well having a casing and a wellhead, including:

(a) a body having:
(1) a bottom wall;
(2) a first partition having a partition throughbore; said first partition adapted to form a first cavity between said bottom wall and said first partition; said first cavity having an input port and an output port;
(3) a second partition adapted to form a second cavity between said first partition and said second partition;
(4) a third partition adapted to form a third cavity between said second partition and said third partition;
(5) a top wall adapted to form a fourth cavity between said third partition and said top wall; and
(6) a cylindrically shaped side wall;

(b) a first spool valve slidably mounted in said second cavity in close proximity to said first partition such that said first spool valve is axially displaceable therein; said first spool valve having a first neutral configuration and a first switching configuration; said first spool valve having:
(1) a first throughbore;
(2) a first spool valve spring adapted to urge said first spool valve from said first switching configuration to said first neutral configuration;
(3) a first stop for defining said first neutral configuration;
(4) a first bypass cavity; and
(5) a first bypass orifice adapted, in cooperation with said first throughbore, to equalize pressure about said first spool valve;

(c) a second spool valve slidably mounted in said second cavity in close proximity to said second partition such that said second spool valve is axially displaceable therein; said second spool valve having a second neutral configuration and a second switching configuration; said second spool valve having:
(1) a second throughbore;
(2) a second spool spring adapted to urge said second spool valve from said second switching configuration to said second neutral configuration;
(3) a second stop for defining said second neutral configuration;
(4) a second bypass cavity; and
(5) a second bypass orifice adapted, in cooperation with said second throughbore, to equalize pressure about said second spool valve;

(d) a piston having:
(1) a piston rod with a first rod end and a second rod end; said piston rod slidably mounted through said partition throughbore and loosely mounted through said first throughbore such that said piston rod is axially displaceable between an extended configuration and a retracted configuration;
(2) a first piston head connected to said first rod end; said first piston head slidably mounted in said first cavity such that said first piston head is axially displaceable therein; said first piston head adapted to form a lower pumping chamber between said first piston head and said lower wall and to form an upper pumping chamber between said first piston head and said first partition; and
(3) a second piston head connected to said second rod end; said second piston head slidably mounted in said second cavity such that said second piston head is axially displaceable therein; said second piston head adapted to form a lower driving chamber between said second piston head and said first partition and to form an upper driving chamber between said second piston head and said second partition; said second piston head adapted to urge said first spool valve from said first neutral configuration to said first switching configuration as said piston rod nears and reaches said extended configuration; said second piston head adapted to urge said second spool valve from said second neutral configuration to said second switching configuration as said piston rod nears and reaches said retracted configuration;

(e) a set of one-way valves adapted such that the crude oil flows into said lower pumping chamber through said input port and concurrently out of said upper pumping chamber through said output port as said piston rod is displaced from said extended configuration to said retracted configuration; said set of one-way valves further adapted such that the crude oil concurrently flows out of said lower pumping chamber through said output port and concurrently into said upper-pumping chamber through said input port as said piston rod is displaced from said retracted configuration to said extended configuration;

(f) a packer adapted to partition the oil well such that said input port communicates with the oil well below said packer and said output port communicates with the oil well above said packer;

(g) a first accumulator disposed in said fourth cavity; said first accumulator having:
(1) a first buffer cavity;
(2) a first buffer plate mounted in said first buffer cavity such that said first buffer plate is axially displaceable between a first uncompressed configuration and a first compressed configuration;
(3) a first accumulator spring adapted to urge said first buffer plate from said first compressed configuration to said first uncompressed configuration; and
(4) a first buffer stop adapted to define said first uncompressed configuration;

(h) a hydraulic pump, including hydraulic fluid;

(i) hydraulic lines, including a source line adapted to convey pressurized hydraulic fluid from said hydraulic pump to said body and a return line adapted to convey depressurized hydraulic fluid from said body to said hydraulic pump; said lines adapted to suspend said body from said wellhead; and (j) a third spool valve slidably mounted in said third cavity such that said third spool valve is axially displaceable therein; said third spool valve adapted to form a lower switching chamber between said second partition and said third spool valve and to form an upper switching chamber between said third spool valve and said third partition; said third spool valve having a lower switching configuration and an upper switching configuration; said third spool valve adapted to be hydraulically urged by said hydraulic pump from said lower switching configuration to said upper switching configuration and from said upper switching configuration to said lower switching configuration; said third spool valve having:

(1) an upper bypass cavity;

(2) an intermediate bypass cavity;

(3) a lower bypass cavity;

(4) a lower spool stop for defining said lower switching configuration;

(5) an upper spool stop for defining said upper switching configuration;

(6) a detent mechanism adapted to restrain said third spool valve in said lower switching configuration and in said upper switching configuration; and (7) a second accumulator disposed in said intermediate bypass cavity; said second accumulator having:

(A) a second buffer cavity;

(B) a second buffer plate mounted in said second buffer cavity such that said second buffer plate is axially displaceable between a second uncompressed configuration and a second compressed configuration;

(C) a second accumulator spring adapted to urge said second buffer plate from said second compressed configuration to said second uncompressed configuration; and (D) a second buffer stop adapted to define said second uncompressed configuration;

(k) a plurality of interconnections integrally formed in said side wall; said interconnection adapted as follows:

(1) to connect said fourth cavity to said source line;

(2) as said second piston head urges said first spool valve from said first neutral configuration to said first switching configuration: to disconnect said lower switching chamber from said return line and to connect said lower switching chamber to said source line;

(3) as said first spool valve assumes said first switching configuration and said third spool valve is being displaced from said lower switching configuration to said upper switching configuration:

(A) to disconnect said upper driving chamber from said source line and to connect said upper driving chamber to said return line; and (B) to disconnect said lower driving chamber from said return line and to connect said lower driving chamber to said source line;

(4) as said piston rod is displaced from said extended configuration toward said retracted configuration and said first spool valve is displaced from said first switching configuration to said first neutral configuration: to disconnect said lower switching chamber from said source line and to connect said lower switching chamber to said return line;

(5) as said second piston head urges said second spool valve from said second neutral configuration to said second switching configuration: to disconnect said upper switching chamber from said return line and to connect said upper switching chamber to said source line;

(6) as said second spool valve assumes said second switching configuration and said third spool valve is being displaced from said upper switching configuration to said lower switching configuration:

(A) to disconnect said upper driving chamber from said return line and to connect said upper driving chamber to said source line; and (B) to disconnect said lower driving chamber from said source line and to connect said lower driving chamber to said return line; and (7) as said piston rod is displaced from said retracted configuration toward said extended configuration and said second spool valve is displaced from said second switching configuration to said second neutral configuration: to disconnect said upper switching chamber from said source line and to connect said upper switching chamber to said return line.

13. A linear fluid motor system for retrieving product fluid from a source, said motor system connected to an energizing means such that energy is transferred to said motor system by pressurized fluidic means from said energizing means, said motor system comprising:

(a) pumping means for pumping the product fluid;

(b) controlling means for automatically and reciprocally controlling said pumping means;

(c) interconnecting means for fluidically interconnecting said pumping means and said controlling means;

(d) containing means for containing said pumping means, said controlling means, and said interconnecting means; said containing means including a lower wall, an upper wall, and partitioning means for partitioning said containing means;

(e) said partitioning means including:

(1) a first partition such that a first cavity is formed between said lower wall and said first partition, said first cavity being adapted to receive said product fluid from said source; and (2) a second partition such that a second cavity is formed between said first partition and said second partition, said second cavity receiving said fluidic means from said energizing means;

(f) said pumping means including:

(1) a piston rod having a first rod end and a second rod end; said piston rod slidably mounted within said containing means such that said piston rod is axially displaceable between an extended configuration and a retracted configuration;

(2) a first piston head connected to said first rod end; said first piston head adapted to interact with the product fluid contained in said first cavity; said first piston head adapted to form an outer pumping chamber between said first piston head and said bottom wall and to form an inner pumping chamber between said first piston head and said first partition; and (3) a second piston head connected to said second rod end; said second piston head responsive to said fluidic means contained in said second cavity; said second piston head adapted to form a lower driving chamber between said second piston head and said first partition and to form an upper driving chamber between said second piston head and said second partition;

(g) said partitioning means including a third partition such that a third cavity is formed between said second partition and said third partition; and (h) said controlling means including:

(1) a first spool valve disposed in said lower driving chamber such that said first spool valve is slidably displaceable axially therein;

(2) a second spool valve disposed in said upper driving chamber such that said second spool valve is slidably displaceable axially therein; and (3) a third spool valve disposed in said third cavity such that said third spool valve is slidably displaceable axially therein between a lower switching configuration and an upper switching configuration; said third spool valve adapted to form a lower switching chamber between said third spool valve and said second partition, and to form an upper switching chamber between said third spool valve and said third partition.

14. The motor system according to claim 13, including:

(a) a third spool lower stop for defining said lower switching configuration.

15. The motor system according to claim 13, including:

(a) a third spool upper stop for defining said upper switching configuration.

16. The motor system according to claim 13, including:

(a) restraining means for restraining said third spool valve in said lower switching configuration and in said upper switching configuration.

17. The motor system according to claim 16, wherein:

(a) said restraining means includes at least one detent mechanism.

18. The motor system according to claim 13, including:

(a) cushioning means for automatically cushioning abrupt pressure changes in the fluidic means.

19. The motor system according to claim 18, wherein said cushioning means includes:

(a) a first accumulator having a first buffer cavity formed between said third partition and said upper wall; said first accumulator connected in flow communication with the fluidic means from the energizing means.

20. The motor system according to claim 19, wherein said first accumulator includes:

(a) a first buffer plate mounted in said first buffer cavity such that said first buffer plate partitions said first buffer cavity into an outer first buffer chamber and an inner first buffer chamber; said first buffer plate adapted to be displaceable between a first compressed configuration and a first uncompressed configuration;

(b) a first accumulator spring disposed in said inner first buffer chamber; said first accumulator spring adapted to urge said first buffer plate from said first compressed configuration to said first uncompressed configuration; and (c) a first bleed port adapted to connect said inner first buffer chamber in flow communication with the fluidic means being returned to the energizing means.

21. The motor system according to claim 20, including:

(a) a first buffer stop adapted to define said first uncompressed configuration.

22. The motor system according to claim 18, wherein said cushioning means includes:

(a) said third spool valve having a second accumulator with a second buffer cavity; said second accumulator connected in flow communication with the fluidic means from the energizing means.

23. The motor system according to claim 22, wherein said second accumulator includes:

(a) a second buffer plate mounted in said second buffer cavity such that said second buffer plate partitions said second buffer cavity into an outer second buffer chamber and an inner second buffer chamber; said second buffer plate adapted to be displaceable between a second compressed configuration and a second uncompressed configuration;

(b) a second accumulator spring disposed in said inner second buffer chamber; said second accumulator spring adapted to urge said second buffer plate from said second compressed configuration to said second uncompressed configuration; and (c) a second bleed port adapted to connect said inner second buffer chamber in flow communication with the fluidic means being returned to the energizing means.

24. The motor system according to claim 23, including:

(a) a second buffer stop adapted to define said second uncompressed configuration.

25. The motor system according to claim 13, including:

(a) said first spool valve having a first switching configuration and a first neutral configuration; and (b) a first spool spring adapted to urge said first spool valve from said first switching configuration to said first neutral configuration.

26. The motor system according to claim 25, including:

(a) a first spool stop adapted to define said first neutral configuration.

27. The motor system according to claim 25, wherein:

(a) said second piston head is adapted to urge said first spool valve from said first neutral configuration to said first switching configuration as said piston rod nears and reaches said extended configuration.

28. The motor system according to claim 13, including:

(a) said second spool valve having a second switching configuration and a second neutral configuration; and (b) a second spool spring adapted to urge said second spool valve from said second switching configuration to said second neutral configuration.

29. The motor system according to claim 28, including:

(a) a second spool stop adapted to define said second neutral configuration.

30. The motor system according to claim 28, wherein:

(a) said second piston head is adapted to urge said second spool valve from said second neutral configuration to said second switching configuration as said piston rod nears and reaches said retracted configuration.

31. The motor system according to claim 13, including:

(a) first pressure equalizing means for equalizing the pressure of said fluidic means about said first spool valve.

32. The motor system according to claim 31, wherein:

(a) said first pressure equalizing means includes said first spool valve having a first throughbore.

33. The motor system according to claim 32, wherein:

(a) said first throughbore encircles said piston rod such that said piston rod is axially displaceable relative thereto.

34. The motor system according to claim 32, wherein:

(a) said first spool valve has a first bypass orifice which cooperates with said first throughbore to equalize the pressure of said fluidic means about said first spool valve.

35. The motor system according to claim 13, including:

(a) second pressure equalizing means for equalizing the pressure of the fluidic means about said second spool valve.

36. The motor system according to claim 35, wherein:

(a) said second pressure equalizing means includes said second spool valve having a second throughbore.

37. The motor system according to claim 36, wherein:

(a) said second spool valve has a second bypass orifice which cooperates with said second throughbore to equalize the pressure of said fluidic means about said second spool valve.

38. The motor system according to claim 13, including:

(a) a supply conduit adapted to convey the fluidic means from the energizing means to said motor system; and (b) a return conduit adapted to convey the fluidic means from said motor system to the energizing means.

39. The motor system according to claim 38, wherein:

(a) said supply conduit and said return conduit are generally coaxial.

40. The motor system according to claim 38, wherein:

(a) the energizing means energizes said motor system by maintaining a pressure differential between the fluidic means in said supply conduit and the fluidic means in said return conduit.

41. The motor according to claim 40, wherein:

(a) said pressure differential is approximately 1000 pounds per square inch.

42. The motor system according to claim 38, wherein:

(a) said first spool valve has a first switching configuration, a first neutral configuration, and a first spool spring adapted to urge said first spool valve from said first switching configuration to said first neutral configuration;

(b) said second spool valve has a second switching configuration, a second neutral configuration, and a second spool spring adapted to urge said second spool valve from said second switching configuration to said second neutral configuration; and (c) said second piston head is adapted to urge said first spool valve from said first neutral configuration to said first switching configuration as said piston rod nears and reaches said extended configuration; said second piston head is further adapted to urge said second spool valve from said second neutral configuration to said second switching configuration as said piston rod nears and reaches said retracted configuration.

43. The motor system according to claim 42, wherein:

(a) said interconnecting means is adapted to disconnect said lower driving chamber from said return conduit and to connect said lower driving chamber to said supply conduit as said second piston head urges said first spool valve from said first neutral configuration to said first switching configuration.

44. The motor system according to claim 42, wherein:

(b) said interconnecting means is adapted to (1) disconnect said upper driving chamber from said supply conduit and connect said upper driving chamber to said return conduit, and (2) disconnect said lower driving chamber from said return conduit and connect said lower driving chamber to said supply conduit, as said first spool valve assumes said first switching configuration and said third spool valve is being displaced from said lower switching configuration to said upper switching configuration.

45. The motor system according to claim 44, including:

(a) means forming an intermediate bypass cavity on said third spool valve; and (b) first stepwise connecting means for stepwise connecting said intermediate bypass cavity to said lower driving chamber as said third spool valve is displaced from said lower switching configuration to said upper switching configuration.

46. The motor system according to claim 44, including:

(a) means forming a lower bypass cavity on said third spool valve; and (b) second stepwise connecting means for stepwise connecting said lower bypass cavity to said upper driving chamber as said third spool valve is displaced from said lower switching configuration to said upper switching configuration.

47. The motor system according to claim 42, wherein:

(1) said interconnecting means is adapted to disconnect said lower switching chamber from said supply conduit and to connect said lower switching chamber to said return conduit as said piston rod is displaced from said extended configuration toward said retracted configuration and said first spool valve is displaced from said first switching configuration to said first neutral configuration.

48. The motor system according to claim 42, wherein:

(a) said interconnecting means is adapted to disconnect said upper switching chamber from said return conduit and to connect said upper switching chamber to said supply conduit as said second piston head urges said second spool valve from said second neutral configuration to said second switching configuration.

49. The motor system according to claim 42, wherein:

(a) said interconnecting means is adapted to (1) disconnect said upper driving chamber from said return conduit and connect said upper driving chamber to said supply conduit, and (2) disconnect said lower driving chamber from said supply conduit and connect said lower driving chamber to said return conduit, as said second spool valve assumes said second switching configuration and said third spool valve is being displaced from said upper switching configuration to said lower switching configuration.

50. The motor system according to claim 42, wherein:

(a) said interconnecting means is adapted to disconnect said upper driving chamber from said supply conduit and to connect said upper driving chamber to said return conduit as said piston rod is displaced from said retracted configuration toward said extended configuration and said second spool valve is displaced from said second switching configuration to said second neutral configuration.

* * * * *